US008749096B2

(12) United States Patent
Tang

(10) Patent No.: US 8,749,096 B2
(45) Date of Patent: Jun. 10, 2014

(54) ANTISTATIC SWITCH AND ELECTRONIC DEVICE WITH ANTISTATIC SWITCH

(75) Inventor: Xing-Hua Tang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 442 days.

(21) Appl. No.: 13/191,453

(22) Filed: Jul. 27, 2011

(65) Prior Publication Data

US 2013/0002043 A1 Jan. 3, 2013

(30) Foreign Application Priority Data

Jun. 29, 2011 (CN) ..... 201110179732.8

(51) Int. Cl.
*H01H 79/00* (2006.01)

(52) U.S. Cl.
USPC ..... 307/100

(58) Field of Classification Search
USPC ..... 307/100
See application file for complete search history.

(56) References Cited

U.S. PATENT DOCUMENTS

2009/0230292 A1* 9/2009 Koyama et al. ..... 250/214 R

* cited by examiner

*Primary Examiner* — Robert L. Deberadinis
(74) *Attorney, Agent, or Firm* — Novak Druce Connolly Bove + Quigg LLP

(57) ABSTRACT

An antistatic switch connected between a micro control unit and a power supply of an electronic device includes six terminals. A first terminal is left vacant and a third terminal is connected to the power supply. A second terminal is public access terminal connected to the micro control unit and selectively connected to the first terminal or the second terminal. The fourth terminal, the fifth terminal, and the sixth terminal are all grounded to remove the static electricity flowing to the electronic device.

5 Claims, 2 Drawing Sheets

ANTISTATIC SWITCH AND ELECTRONIC DEVICE WITH ANTISTATIC SWITCH

BACKGROUND

1. Technical Field

The present disclosure relates to antistatic switches, and particularly, to an antistatic switch and an electronic device using the same.

2. Description of Related Art

Switches are widely used in electronic devices. One problem with the electronic devices is that static electricity may flow to the electronic devices through the gap between the switches and the shell of the electronic devices, which may damage or destroy electronic elements of the electronic devices. To solve the above problem, as shown in FIG. 1, an antistatic element D1 is employed in the electronic device 100 to remove the static electricity flowing to the electronic device through a switch 10. However, the antistatic element D1 may increase the cost of the electronic device.

BRIEF DESCRIPTION OF THE DRAWINGS

Many aspects of the present disclosure should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail, with reference to the accompanying drawings.

Figure 1:
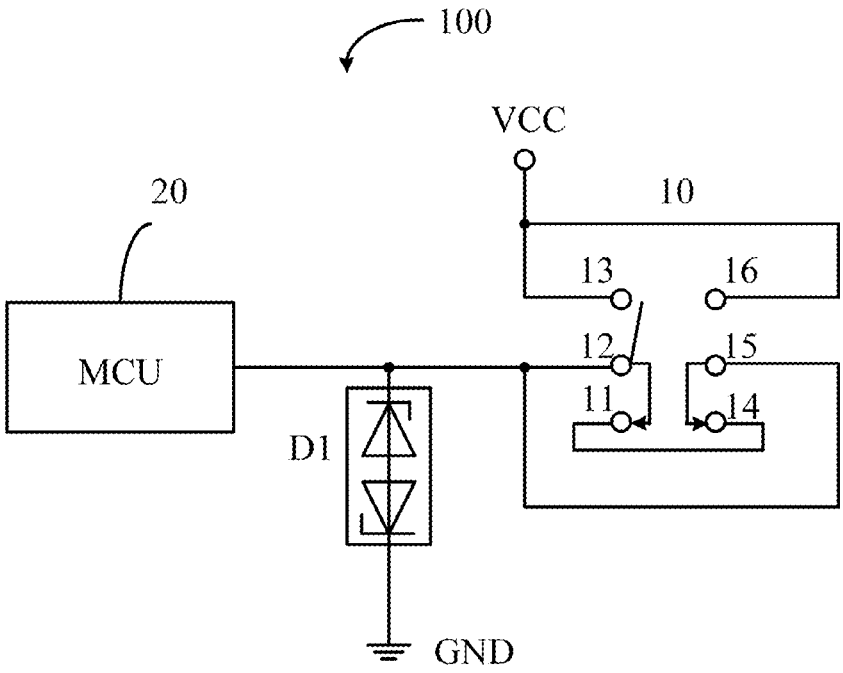
FIG. 1 (Related Art)
FIG. 1 is a circuit diagram of an electronic device of related art.
Figure 2:
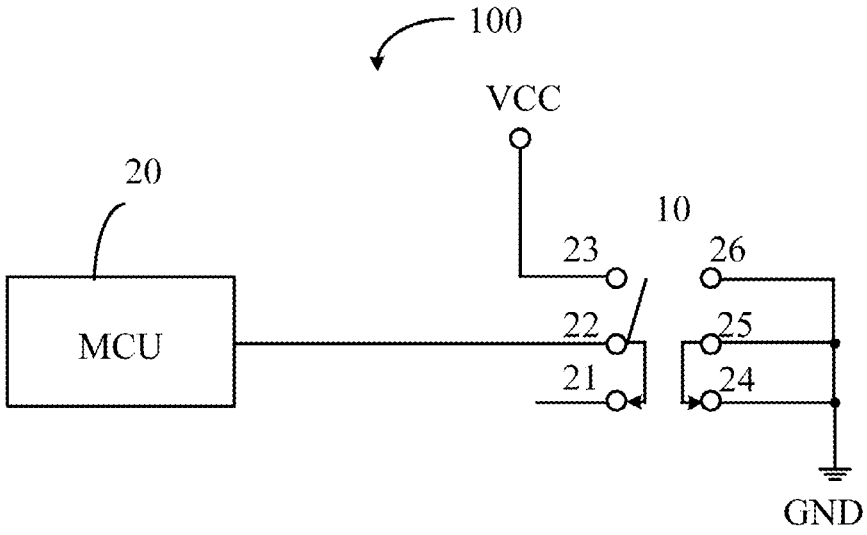
FIG. 2 is a circuit diagram of an electronic device in accordance with an exemplary embodiment.

Referring to FIG. 2, an electronic device 100 includes a power supply VCC, an antistatic switch 10, and a micro control unit (MCU) 20. In this embodiment, the switch 10 includes a first terminal 21, a second terminal 22, a third terminal 23, a fourth terminal 24, a fifth terminal 25, and a sixth terminal 26. The electronic device 100 may be a digital versatile disc (DVD) player for example.

In this embodiment, the first terminal 21 is left vacant, while the third terminal 23 is connected to the power supply VCC. The second terminal 22 is a public access terminal connected to the MCU 20 and selectively connected to the first terminal 21 or the third terminal 23.

When the second terminal 22 is connected to the first terminal 21, the MCU 20 is disconnected from the power supply VCC and generates a first signal to control the electronic device 100 to execute a first function. When the second terminal 22 is connected to the third terminal 23, the MCU 20 is connected to the power supply VCC and generates a second signal to control the electronic device 100 to execute a second function. In this embodiment, the switch 10 is used to enable and disable buttons of the electronic device 100. When the second terminal 22 is connected to the first terminal 21, the MCU 20 generates the first signal to enable the buttons of the electronic device 100. When the second terminal 22 is connected to the third terminal 23, the MCU 20 generates the second signal to disable the buttons of the electronic devices 100.

The fourth terminal 24, the fifth terminal 25, and the sixth terminal 26 are all grounded to remove the static electricity flowing to the electronic device 100 through the switch 10.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. An antistatic switch for being connected between a micro control unit and a power supply of an electronic device, the antistatic switch comprising:

a first terminal, a second terminal, a third terminal, a fourth terminal, a fifth terminal, and a sixth terminal; the first terminal being left vacant and the third terminal being connected to the power supply, the second terminal being a public access terminal to be connected to the micro control unit and being selectively connected to the first terminal or the third terminal; the fourth terminal, the fifth terminal, and the sixth terminal are all grounded.

2. An electronic device comprising:

a power supply;

a micro control unit; and an antistatic switch connected between the power supply and the micro control unit, wherein the antistatic switch comprising a first terminal, a second terminal, a third terminal, a fourth terminal, a fifth terminal, and a sixth terminal; the first terminal being left vacant and the third terminal being connected to the power supply, the second terminal being a public access terminal connected to the micro control unit and being selectively connected to the first terminal or the third terminal; the fourth terminal, the fifth terminal, and the sixth terminal are all grounded.

3. The electronic device as described in claim 2, wherein when the second terminal is connected to the first terminal, the micro control unit generates a first signal to control the electronic device to execute a first function, when the second terminal is connected to the third terminal, the micro processing unit generates a second signal to control the electronic device to execute a second function.

4. The electronic device as described in claim 3, wherein the antistatic switch is configured to enable and disable buttons of the electronic device, when the second terminal is connected to the first terminal, the micro control unit generates a first signal to enable the buttons of the electronic device, when the second terminal is connected to the third terminal, the micro control unit generates a second signal to disable the buttons of the electronic device.

5. The electronic device as described in claim 2, wherein the electronic device is a digital versatile disc player.

* * * * *